United States Patent [19]

Ohkoshi et al.

[11] Patent Number: 4,857,800

[45] Date of Patent: Aug. 15, 1989

[54] ELECTRON BEAM INDICATOR TUBE WITH ACCELERATING ELECTRODE

[75] Inventors: Akio Ohkoshi; Hideaki Nakagawa, both of Tokyo; Koji Tsuruta, Kanagawa; Yasuyoshi Sugii, Tokyo; Haruaki Wada, Chiba, all of Japan

[73] Assignee: Sony Corporation, Tokyo, Japan

[21] Appl. No.: 201,181

[22] Filed: Jun. 2, 1988

[30] Foreign Application Priority Data

Jun. 9, 1987 [JP] Japan ..... 62-143777

[51] Int. Cl.[4] ..... H01J 19/38; H01J 63/06

[52] U.S. Cl. ..... 313/495; 313/497; 313/349

[58] Field of Search ..... 313/495, 497, 349, 496, 313/491, 492, 493, 414

[56] References Cited

U.S. PATENT DOCUMENTS 4,608,518 8/1986 Fukuda et al. ..... 313/481

*Primary Examiner*—Kenneth Wieder

[57] ABSTRACT

An electron beam indicator, for example, for a large-screen display which has a two-dimensional arrangement of a plurality of electron beam indicators. The electron beam indicator tube comprises fluorescent trios each of which have a plurality of fluorescent layers which function as picture elements, and a plurality of linear cathodes which are disposed respectively opposite to the fluorescent layers of the fluorescent trios. A common accelerating electrode is disposed between the fluorescent trios and control electrodes, and a separator structure is disposed so as to shield the fluorescent layers of each fluorescent trio. The common accelerating electrode is curved in the direction which the linear cathodes extend in a convex shape which bulged outwardly toward the fluorescent layers, and is formed so that the width of the electron beam transmission apertures decreases from the central portion toward the opposite ends. The electron beam which impinge on the separators of the separator structure are cut off by the accelerating electrode to which a low voltage is applied and hence the reactive current is reduced and luminous efficiency of the fluorescent layers is improved and the power consumption is reduced.

6 Claims, 7 Drawing Sheets

ELECTRON BEAM INDICATOR TUBE WITH ACCELERATING ELECTRODE

BACKGROUND OF THE INVENTION

1. Field of the Invention

The present invention relates to an electron beam indicator tube of high luminance, for example, for a large-screen display having a two-dimensional arrangement of a plurality of such electron beam indicator tubes.

2. Description of the Prior Art

There has been proposed a display comprising a large screen having a two-dimensional arrangement of luminous indicator cells each having fluorescent trios each consisting of cathodes, first grids, second grids and, for example, red, green and blue fluorescent layers.

FIGS. 10, 11 and 12 illustrate an exemplary electron beam indicator tube, i.e., a luminous indicator cell, integrally incorporating two sets of fluorescent trios. This luminous indicator cell comprises a glass case 1, two sets of fluorescent trios 3 (3A and 3B) are formed in the glass case 1 and each consist of red, green and blue fluorescent layers 2R, 2G and 2B which have the same areas. There are three linear cathodes K ($K_R$, $K_G$ and $K_B$) disposed, respectively, opposite to the fluorescent layers 2R, 2G and 2B of each of the fluorescent trios 3A and 3B. There are electrode units 4 (4A and 4B) each consisting of three first grids (control grids) $G_1$ ($G_{1R}$, $G_{1G}$ and $G_{1B}$) and a common second grid (accelerating grid ($G_2$. There is also a separator structure 5 formed of a conductive material so as to enclose the fluorescent layers 2R, 2G and 2B of each of the two sets of fluorescent trios 3. Rectangular, meshy electron beam transmission apertures 6R, 6G and 6B which have the same shape as the fluorescent layers 2R, 2G and 2B are formed in the second grid $G_2$ at positions, respectively, corresponding to the first grids $G_{1R}$, $G_{1G}$ and $G_{1B}$.

An anode lead 7 is connected to a conductive getter container 8 mechanically supported on and electrically connected to part of the separator structure 5, and which projects outside through a chip-off tube 9 which is attached to the backside of the glass case 1.

In this luminous indicator cell disclosed in Japanese Patent Application Nos. 60-191703 and 59-256357, a fixed anode voltage in the order of 8 kV is applied through the anode lead 7 and the separator structure 5 to the red, green and blue fluorescent layers 2R, 2G and 2B of each of the fluorescent trios 3. A voltage, for example, in the range of 0 to 5 V is applied to the first grids $G_1$. A fixed voltage, for example, in the range of 30 to 50 V is applied to the second grid $G_2$, and the voltage applied to the first grids $G_1$ is selectively removed and supplied to an indicator.

In the foregoing known luminous indicator cell, the fluorescent layers are arranged contiguously with a small gap therebetween, and a small current is supplied to the separator structure 5 which has an anode potential which causes the entire area of the fluorescent layer to compensate for variations attributable to irregularities caused during assembly of the luminous indicator cell. The temperature of the opposite ends of the linear cathodes K drops during operation and the opposite ends of the linear cathodes K are unable to discharge sufficient thermions and, consequently, the respective upper and lower ends of the fluorescent layers 2R, 2G and 2B have low luminance.

SUMMARY OF THE INVENTION

In view of the foregoing problems which occur in conventional luminous indicator cells, it is an object of the present invention to provide an electron beam indicator tube which eliminates the occurrence of low luminance portions in the fluorescent layers attributable to the low-temperature opposite ends of the linear cathodes, by reducing the reactive current flowing through the separator structure so as to reduce the substantial anode current and so as to improve the luminous efficiency of the fluorescent layers.

To achieve the object of the invention, the present invention provides an electron beam indicator tube comprising an insulating case 1, with one or a plurality of sets of fluorescent trios provided in the insulating case 1 and each comprising three color fluorescent layers 2, for example, a red fluorescent layer 2R, a green fluorescent layer 2G and a blue fluorescent layer 2B. A plurality of linear cathodes K and a plurality of control grids $G_1$, respectively, for the fluorescent layers 2 of each fluorescent trio 3 are also provided, and a common accelerating electrode $G_2$ is provided for each fluorescent trio 3. A separator structure 5 is provided so as to surround the fluorescent layers 2 of each fluorescent trio. The common accelerating electrode $G_2$ is curved with a predetermined curvature with respect to the direction at which the linear cathodes K extend and is formed in a convex surface which bulges out toward the fluorescent layers 2 and is formed so that the width of the electron beam transmission apertures 6 decreases from the central portion toward the opposite ends.

In an electron beam indicator tube of high luminance according to the present invention for a display comprising a two-dimensional arrangement of a plurality of such electron beam indicator tubes of high luminance as indicator cells, the common accelerating electrode, i.e., a second grid $G_2$, is curved with respect to the direction at which the linear cathodes extend and is formed with a convex shape which bulges out toward the fluorescent layers, and is formed so that the width of the electron beam transmission apertures decreases from the central portion toward the opposite ends of the electron beam transmission apertures with respect to the direction which the linear cathodes extend so as to enable the entire area of the fluorescent layer to become luminous by preventing the reduction of the luminance due to the low-temperature ends of the linear cathodes, and to improve the luminous efficiency and also to reduce the power consumption by reducing the reactive current, which current does not contribute to the luminance.

Since the accelerating electrode $G_2$ is curved with respect to the direction of extension of the linear cathodes K, electron beams 21 which are emitted from the linear cathode K disperse as shown in FIG. 6. An electron beam 21*a* emitted from a position on the linear cathode K at a distance x from one end of the linear cathode K impinges at a position near the upper end of a separator 5*a* of the separator structure 5 which surrounds the fluorescent layer 2. The electron beam transmission apertures 6 of the accelerating electrode $G_2$ each is formed to cutoff electron beams 21 emitted from positions in a section of the linear cathode K from each end to a position at a distance x from the end. Accordingly, electron beams emitted from sections of the linear cathodes K between the ends of the linear cathodes K and a position at a distance x from the ends including portions the temperature of which drops fall on the accelerating electrode $G_2$ and do not reach the fluorescent layers 2, and hence portions having low luminance are not formed in the upper and lower ends of the fluorescent layers 2, the entire areas of the fluorescent layers 2 become luminous, and reactive current which flows through the separators 5*a* and does not contribute to luminance is reduced.

On the other hand, if the separator 5*a* charged at the anode potential is curved along the accelerating electrode $G_2$, the effect of the voltage diffusing lens varies with respect to the direction of extension of the linear cathodes due to the difference in height between the surface of the accelerating electrode and the fluorescent layer. Consequently, the dispersion of the electron beams, namely, the dispersion of the electron beams in the direction perpendicular to the direction of extension of the linear cathodes, varies between positions, and hence electron beams falling on the separators 5*a* increase and the reactive current increases.

According to the present invention, since the electron beam transmission apertures 6 of the accelerating electrode $G_2$ are formed in a barrel shape having width, namely, size along a direction which extends perpendicularly to the direction which the cathodes extend and decreases from the central portion to the opposite ends, the electron beams which fall on the separators 5*a* are cut off by the accelerating electrode $G_2$ to which a low voltage is applied and hence the reactive current is reduced. Accordingly, the luminous efficiency of the fluorescent layers will be improved and power consumption will be reduced.

BRIEF DESCRIPTION OF THE DRAWINGS

The above and other objects, features and advantages of the present invention will become apparent from the following description taken in conjunction with the accompanying drawings, in which.

DESCRIPTION OF THE PREFERRED EMBODIMENTS

Figure 3:
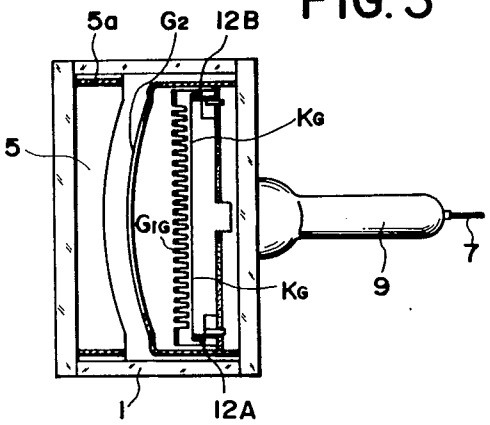
FIG. 3 is a sectional view taken on line B—B in FIG. 1.
Figure 1:
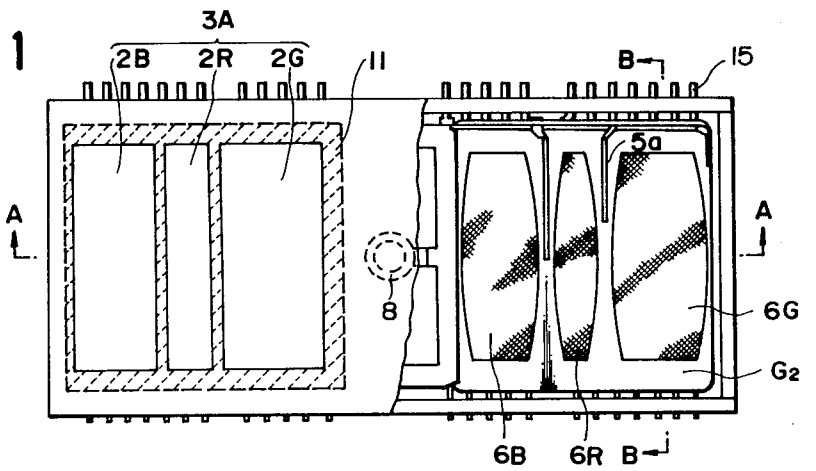
FIG. 1 is a partly cutaway fron elevational view of an electron beam indicator tube, of a preferred embodiment, according to the present invention.
Figure 2:
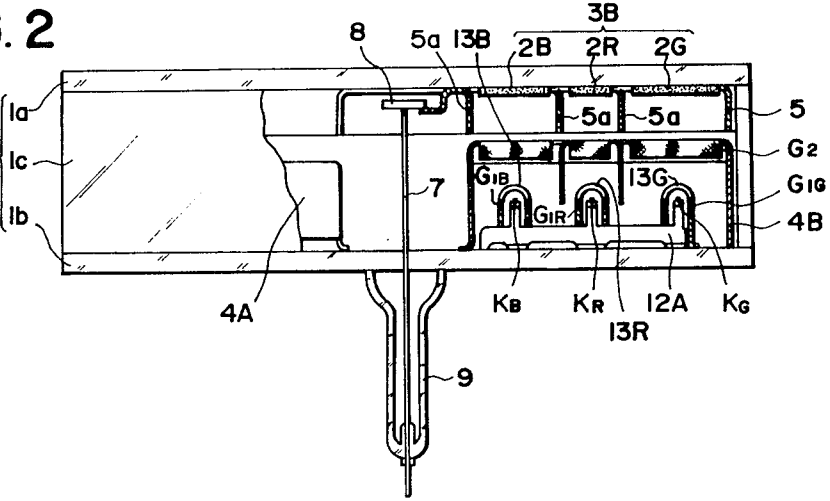
FIG. 2 is a sectional view taken on line A—A in FIG. 1.

A preferred embodiment of an electron beam indicator tube according to the present invention will be described with reference to FIGS. 1 through 4.

In FIGS. 1 through 4, a glass case 1 is illustrated which consists of a front panel 1*a*, a back panel 1*b* and side panels 1*c*. The front panel 1*a* of the glass case 1 has a size of, for example, 41 mm in height and 88 mm in width. Two electron beam indicator units, so-called fluorescent trios 3 (3A and 3B) which have fluorescent layers and function as picture elements, and two electrode units 4 (4A and 4B) are, respectively, disposed opposite to the two fluorescent trios 3 are mounted in the glass case 1. The two fluorescent trios 3 are formed by fluorescent layers which are formed on the inside surfaces of the front panel 1*a*. In this embodiment, each of the fluorescent trios 3 have three fluorescent indicator segments, which are a red fluorescent layer 2R, a green fluorescent layer 2G and a blue fluorescent layer 2B. A carbon layer 11 is printed on the inside surface of the front panel la substantially in the shape of a frame, and then the red fluorescent layer 2R, the green fluorescent layer 2G and the blue fluorescent layer 2B are printed in areas which are not coated with the carbon layer 11 within the frame-shaped carbon layer 11 so as to partly overlap the carbon layer 11. The surfaces of the red fluorescent layer 2R, the green fluorescent layer 2G and the blue fluorescent layer 2B are, respectively, coated through intermediate films with metal backing layers such as aluminum films.

Figure 4:
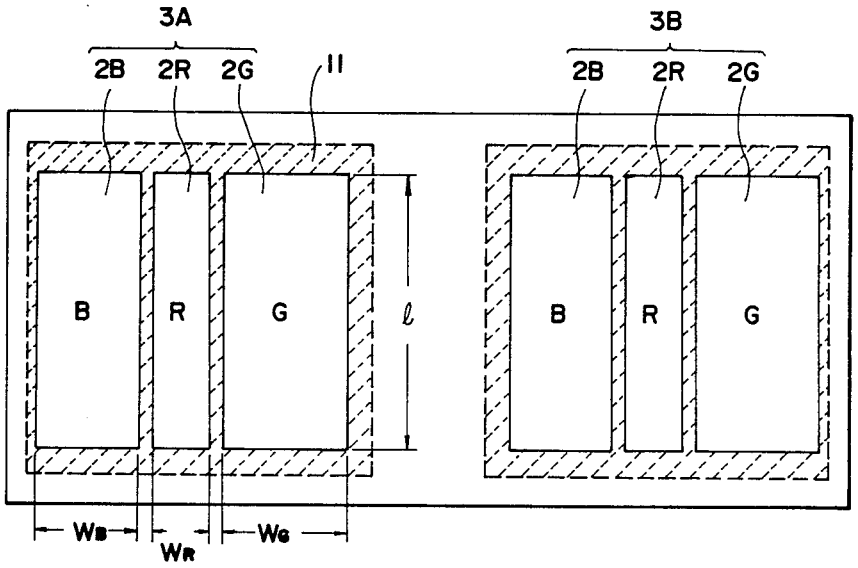
FIG. 4 is a front elevational view of the electron beam indicator tube of FIG. 1.

To enhance the white luminance of the fluorescent layers 2 and to extend their life, the area ratio R:G:B, which are the ratios of areas between the red fluorescent layer 2R, the green fluorescent layer 2G and the blue fluorescent layer 2B, are 0.4 to 0.6:1 to 2:1 instead of an area ratio R:G:B=1:1:1 used in conventional electron beam indicator tubes. In this embodiment, the respective widths $w_R$, $w_G$ and $w_B$ of the red fluorescent layer 2R, the green fluorescent layer 2G and the blue fluorescent layer 2B are 6 mm, 13 mm and 11 mm, respectively and the respective heights are l=33 mm (FIG. 4).

The fluorescent materials which form the fluorescent layers 2 may be $Y_2O_3$/Eu for the red fluorescent layer 2R, Zns/CuAl, $Y_3Al_5O_{12}$/Tb or $Y_2SiO_4$/Tb for the green fluorescent layer 2G, and ZnS/Ag or $Y_3Al_5O_{12}$/Ce for the blue fluorescent layer 2B.

Each electrode unit 4 has a pair of conductive cathode supporting members 12A and 12B and three linear cathodes K ($K_R$, $K_G$ and $K_B$) extend between the cathode supporting members 12A and 12B and are disposed, respectively, opposite to the red fluorescent layer 2R, the green fluorescent layer 2G and the blue fluorescent layer 2B of each fluorescent trio 3. The three first grids $G_1$ ($G_{1R}$, $G_{1G}$ and $G_{1B}$) are, disposed, respectively, opposite to the linear cathodes $K_R$, $K_G$ and $K_B$, and a common second grid $G_2$ commonly corresponds to the three first grids $G_1$. The linear cathodes K are formed, for example, by coating tungsten heaters with an electron emitting substance such as a carbonate. The first grids $G_1$ each have a U-shape in cross-section and have a cylindrical surface, and are, respectively, provided with electron beam transmission apertures 13 (13R, 13G and 13B) and each have a plurality of slits which are arranged in the cylindrical surface at a predetermined pitch along the longitudinal direction. The respective second grids $G_2$ of the electrode units 4A and 4B are interconnected.

A conductive separator structure 5 is disposed near a fluorescent screen so as to surround the fluorescent layers 2R, 2G and 2B of each of the fluorescent trio 3. The separator structure 5 functions both as a shield for preventing secondary electrons from being emitted by the first grids $G_1$ and the second grid $G_2$ when the electron beams which are emitted from the linear cathdoes K impinge against the first grids $G_1$ and the second grid $G_2$ which cause the adjacent fluorescent layers to be luminous, and serve as a so-called diffusion lens which diffuses the electron beams which are emitted from the linear cathdoes K, and which serves as a feed means for applying a high voltage to the fluorescent trios 3. The separator structure 5 has separators 5*a* for partitioning the fluorescent layers 2R, 2G and 2B. The edges of the separators 5 facing the electrode units 4 are curved along the curved surface of the second grids $G_2$.

A conductive getter container 8 is mechanically supported on and is electrically connected to the front panel 1*a*, and an anode lead 7 is connected to the conductive getter container 8. The anode lead 7 extends through and projects from the rear end of a chip-off tube 9 which is attached to the back side of the back panel 1*b*. The first grids $G_1$, the second grids $G_2$ and the pair of cathode supporting members 12A and 12B are directly, respectively, connected electrically by spot welding to lead frames 15 which are arranged on the inside surface of the back panel 1*b* of the glass case 1.

The present embodiment is particularly characterized by the second grids $G_2$. The surface which is provided with the electron transmission apertures 6 (6R, 6G and 6B) of each of the second grids $G_2$ is formed into a convex surface which is curved at a predetermined curvature so that it bulges out toward the fluorescent trio 3, and each of the electron beam transmission apertures 6 is formed in a so-called barrel shape which have widths which decrease from the central portion toward the opposite ends. The respective shapes of the electron beam transmission apertures 6R, 6G and 6B of each of the second grid $G_2$ are selected on the basis of the results of field analysis and from the loci of the electron beams shown in FIGS. 6 through 9.

Figure 6:
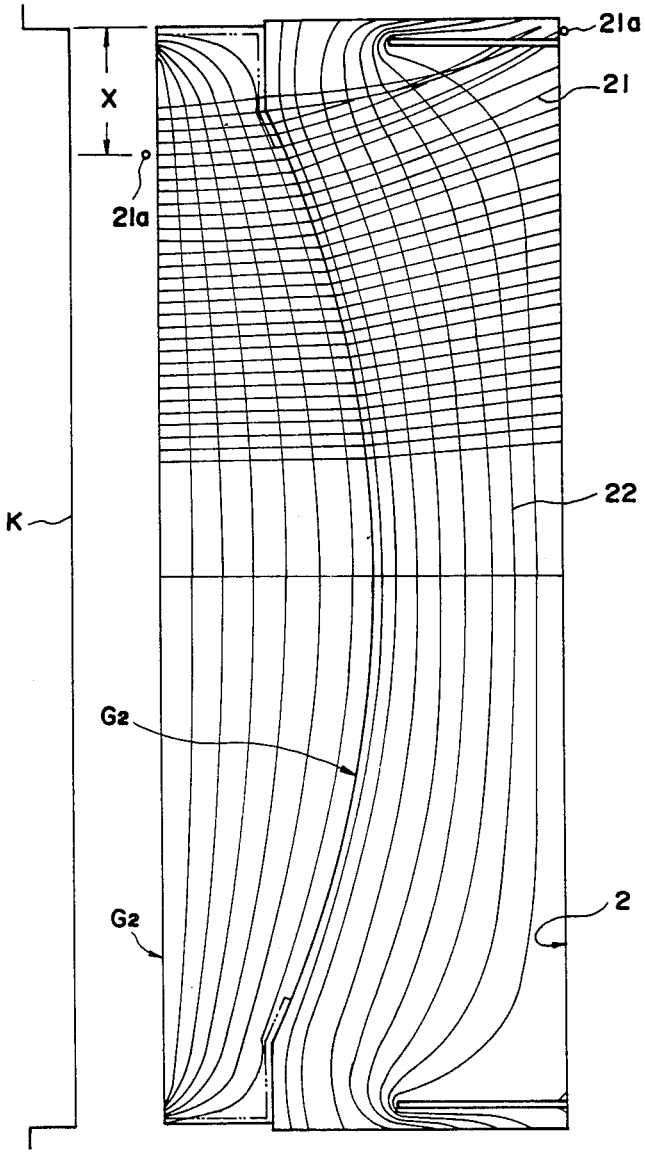
FIGS. 6 through 9B are diagrams for assisting in explaining the present invention, and show the results of a field analysis and the loci of the electron beams.

FIG. 6 shows the result of field analysis and the beam loci with respect to the directions which the linear cathodes K extend in FIG. 3. In this example, the radius R of curvature of the curved surface of the second grid $G_2$ is 35 mm. In FIG. 6, the curved lines 21 indicate the loci of electron beams which are emitted from the cathode K, and the curved lines 22 represent the electrical field. As is obvious from FIG. 6, the electron beams 21 are dispersed by the electrical field, and the electron beam 21 emitted from a position on the linear cathode K at a distance x from one end of the linear cathode K impinge at a position near the upper ends of the separator 5*a* which is charged at an anode potential. Accordingly, the length of the electron beam transmission aperture 6 is selected so that portions of the second grid $G_2$ which are indicated by alternate long and two short dash lines with respect to the direction in which the linear cathodes K extend will cutoff the electron beams which are emitted from sections of the linear cathode K, respectively, from the opposite ends at positions which are at a distance x from the corresponding ends of the linear cathdoe K. The loci of the electron beams are dependent on the radius R of curvature of the curved surface of the second grid $G_2$, and hence the respective shapes of the electron beam transmission apertures 6 are designed by using the radius R of curvature of the second grid $G_2$.

Figure 5:
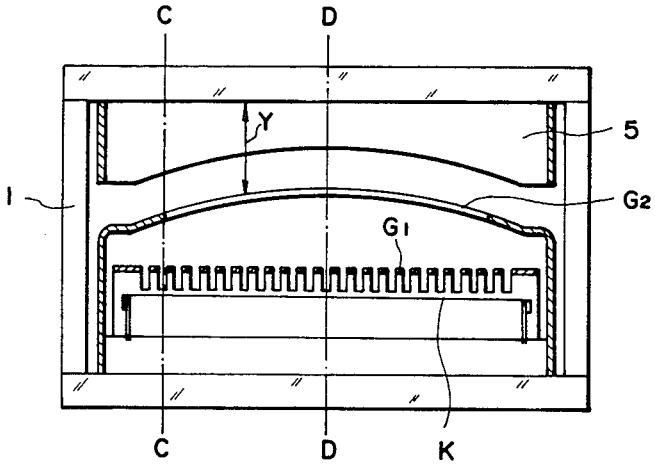

On the other hand, when the second grid $G_2$ is formed into a curved shape, the distance Y between the second grid $G_2$ and the fluorescent layer 2 varies along the direction of extension of the linear cathdoes K (FIG. 5), and hence the high-voltage diffusion lens effect of the second grid $G_2$ varies along the direction of extension of the linear cathdoes K. FIGS. 7A to 7D, 8A to 8D, 9A and 9B show the results of field analysis and the beam loci in a direction which is perpendicular to the direction in which the linear cathodes K extend at the middle portion D of the second grid $G_2$ which is indicated by a line D—D and at an end portion C of the second grid $G_2$ which is indicated by a line C—C.

Figure 7A:
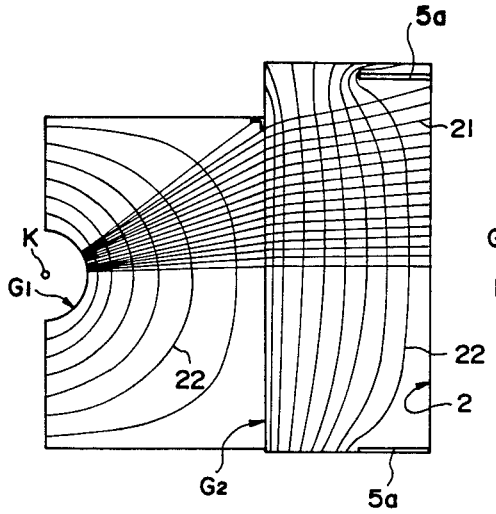
Figure 7B:
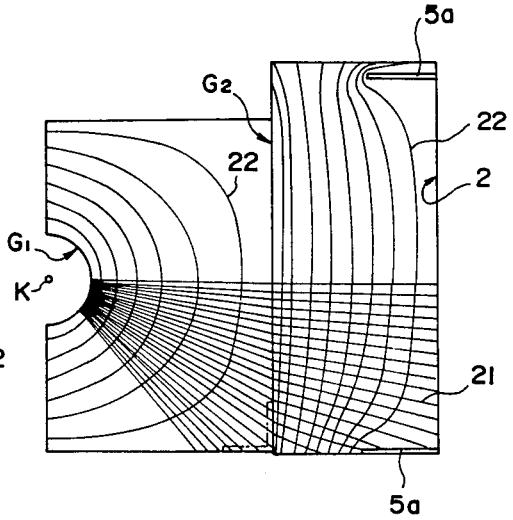
Figure 7C:
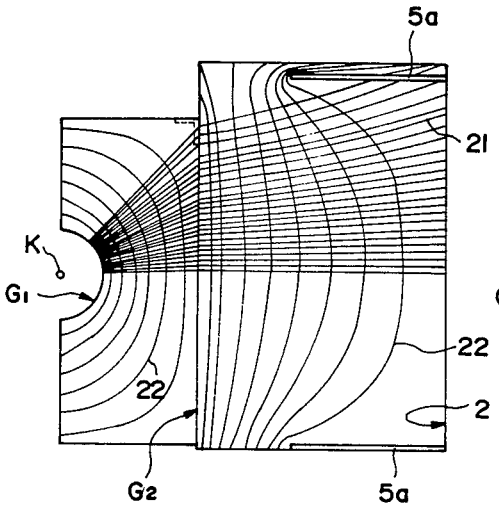
Figure 7D:
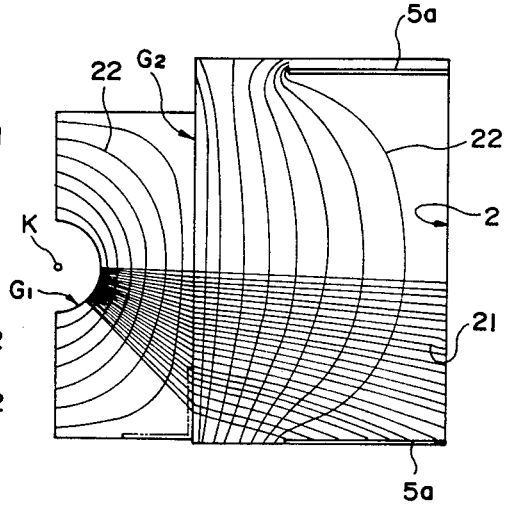
Figure 8A:
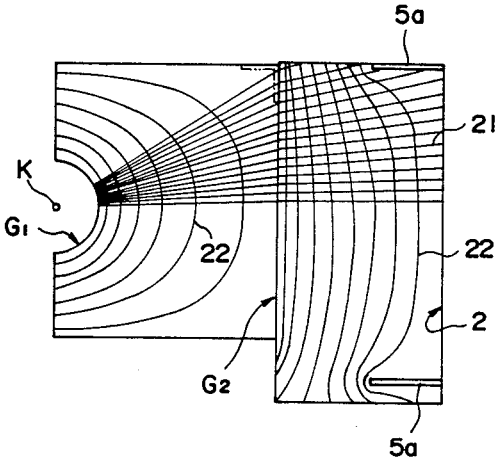
Figure 8B:
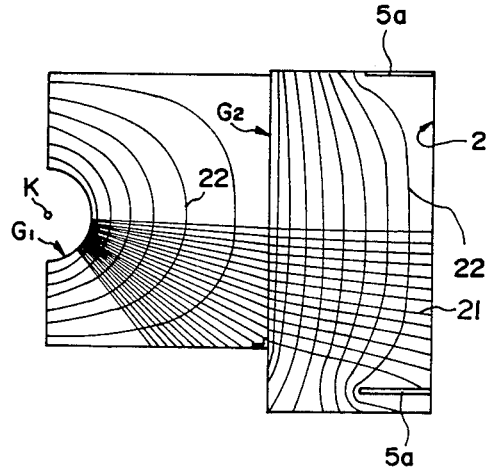
Figure 8C:
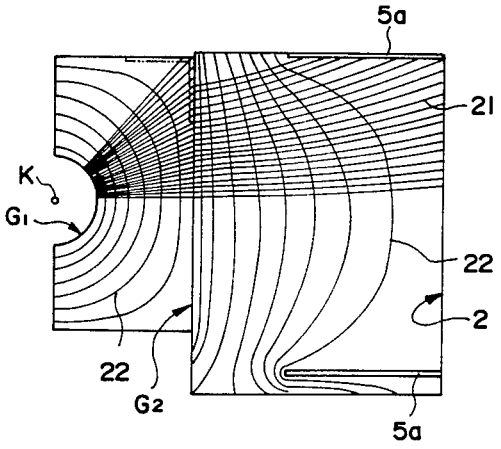
Figure 8D:
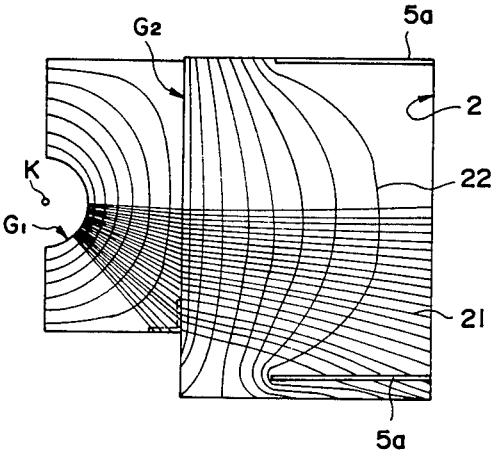

FIGS. 7A and 7B show the beam loci of green electron beams which pass the middle portion D, and FIGS. 7C and 7D show the beam loci of green electron beams which pass the end portion C. As is obvious from FIGS. 7A through 7D, the width of the electron beam transmission aperture 6G is selected so that the electron beams 21 which fall on the separators 5*a* are cut off. Therefore, the electron beam transmission aperture 6G has a so-called barrel shape with a wide middle portion and narrow end portions.

Figure 9A:
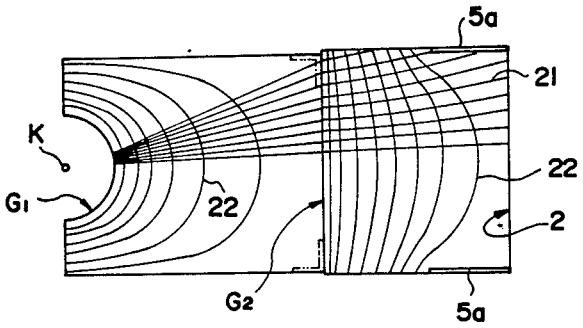
Figure 9B:
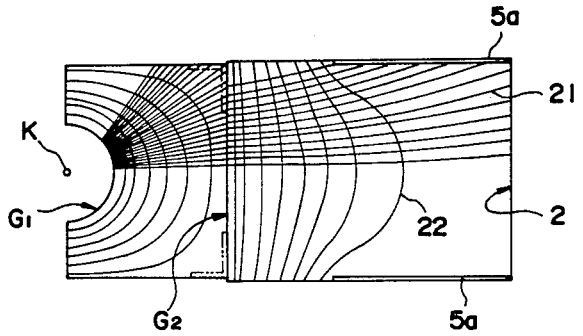
Figure 12:
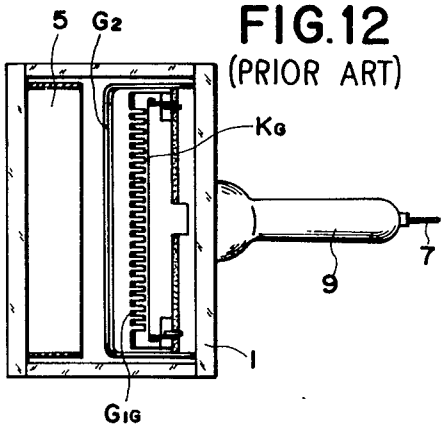
FIG.12 (PRIOR ART)
FIG. 12 is a sectional view taken on line F—F of FIG. 10.
Figure 10:
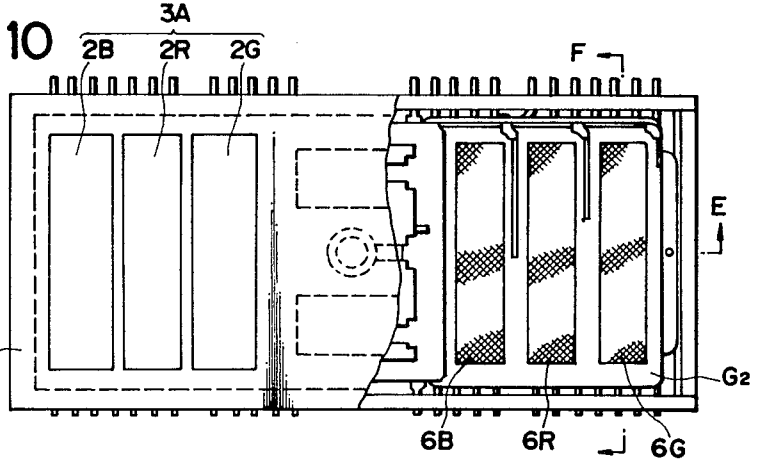
FIG. 10 (PRIOR ART)
FIG. 10 is a partly cutaway front elevational view of a conventional electron beam indicator tube.
Figure 11:
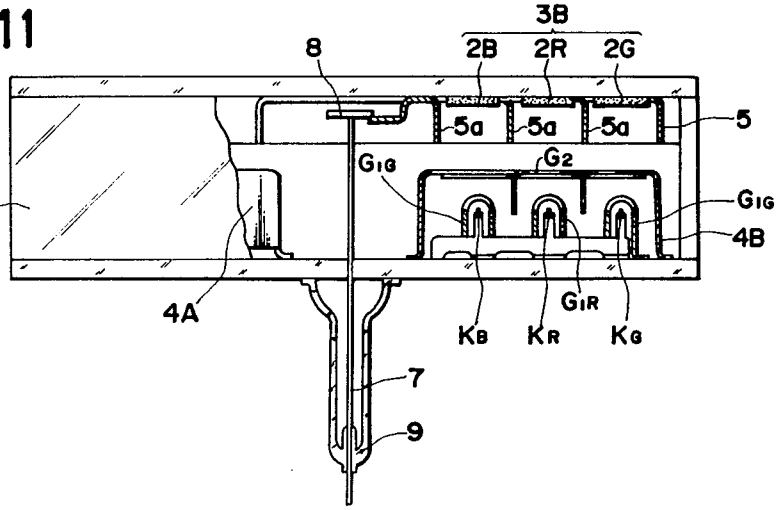
FIG.11 (PRIOR ART)
FIG. 11 is a sectional view taken on line E—E of FIG. 10.

FIGS. 8A through 8D show the loci of the blue electron beams and FIGS. 9A and 9B show the loci of the red electron beams. The electron transmission apertures 6B and 6R for respectively transmitting the blue electron beams and the red electron beams, in a manner which is similar to the electron aperture 6G for the green electron beams, are respectively formed so as to have barrel shapes.

Since the surface of the common second grid $G_2$ which is provided with the electron beam transmission apertures 6 is curved into a convex surface with respect to the direction which the linear cathodes K extend so they bulge out toward the fluorescent screen, the electron beams which are emitted from the linear cathodes K are diffused as shown by the loci of the electron beams in FIG. 6. Since the electron beams are diffused, the respective widths of the electron beam transmission apertures 6 can be reduced. Accordingly, the electron beams which are emitted from the end portions of the low temperature portions of the linear cathodes K impinge on the low-voltage second grid $G_2$, and hence low-luminance portions do not occur at the upper and lower ends of the fluorescent layers 6, and the entire areas of the fluorescent layers 2 are highly luminous and reactive currents which flow through the separators 5*a* are reduced.

On the other hand, when the second grid $G_2$ is curved and the respective lower edges of the separators 5*a* are curved along the surface of the second grid $G_2$, the high-voltage diffusion lens effect varies along the longitudinal direction of the electron beam transmission apertures 6 due to the variations in the distance Y between the second grid $G_2$ and the fluorescent layers 2. However, in this embodiment, since the respective shapes of the electron beam transmission apertures 6 of the second grid $G_2$ are selected on the basis of the loci of the electron beams as shown in FIGS. 7A through 9B, currents other than the anode current which flows through the fluorescent layers 2 are cutoff by the second grid $G_2$, and thus reactive currents which flow through the separator structure 5 and not contribute to luminance can be reduced. Accordingly, the luminous efficiency of the fluorescent layers can be improved because the entire areas of the fluorescent layers can be made to become uniformly luminous and the anode current can substantially be reduced. Thus, the total luminous efficiency of a display having a large screen comprising an arrangement of a plurality of such electron beam indicator tubes can be enhanced and the total power consumption of the unit can be reduced.

In the embodiment described hereinbefore, the component fluorescent layers of each fluorescent trio had different areas but the present invention has the same advantages when applied to an electron beam indicator tube in which the areas of the component fluorescent layers of each fluorescent trio are the same.

Furthermore, in the embodiment described hereinabove, the component fluorescent layers of each fluorescent trio are different in area from each other with the green fluorescent layer having the greatest area, which enhances the white luminance of the fluorescent trio and extends the life of the electron beam indicator tube.

In the conventional electron beam indicator tube which have red, green and blue fluorescent layers with the same areas of 8 mm×29 mm, the respective anode currents which flow through the fluorescent layers are:
Red fluorescent layer: 16 $\mu A/cm^2$
Green fluorescent layer: 56 $\mu A/cm^2$
Blue fluorescent layer: 30 $\mu A/cm^2$
Average luminance: 3000 nit On the other hand, the respective anode currents which flow through the red, green and blue fluorescent layers of the present invention which respectively have different areas of 6 mm×33 mm, 13 mm×33 mm and 11 mm×33 mm are:
Red fluorescent layer: 34 $\mu A/cm^2$
Green fluorescent layer: 34 $\mu A/cm^2$
Blue fluorescent layer: 30 $\mu A/cm^2$
Average luminance: 4000 nit When the luminance of the green fluorescent layer among the fluorescent layers which are the same in area is increased by increasing the current density, the luminance of the blue fluorescent layer must be increased in proportion to the increase in the luminance of the green fluorescent layer, which is not desirable from the viewpoint of the life of the blue fluorescent layer. In this embodiment, the area of the green fluorescent layer is increased relative to the red and blue fluorescent layers so as to reduce the current density in the green fluorescent layer so that the red, green and blue fluorescent layers have substantially the same current densities. Consequently, the life of the fluorescent layers is extended and the luminance of the fluorescent trio is enhanced. Furthermore, since the area ratio between the fluorescent layers of each fluorescent trio of the electron beam indicator tube varies, the luminance of the electron beam indicator tube can be enhanced without reducing the resolution.

Although the invention has been described as applied to an electron beam indicator tube having two fluorescent trios, the present invention is applicable to an electron beam indicator tube having more than two fluorescent trios or to a tube which has one fluorescent trio.

As is apparent from the foregoing description, according to the present invention, in an electron beam indicator tube for use as an indicator cell, comprising fluorescent trios, linear cathodes which are disposed opposite to the fluorescent layers of the fluorescent trios, and with control electrodes disposed, respectively, opposite to the fluorescent layers of the fluorescent trios, and with a common accelerating electrode for each fluorescent trio, the common electrode is curved with respect to the direction in which the linear cathodes extend, and the electron beam transmission apertures are formed so that the width decreases from the middle portion toward the opposite ends, so that the occurrence of low-luminance portions in the fluorescent layers due to temperature drop at the end portions of the linear cathodes is prevented, and the entire areas of the fluorescent layers can be made to be luminous, and the reactive current which flows through the high-voltage side is reduced. Accordingly, the power consumption of a display having a large screen comprising a plurality of such electron beam indicator tubes will be reduced and the luminous efficiency of the display will be improved.

Although the invention has been described in its preferred form with a certain degree of particularly, obviously many changes and variations are possible. It is therefore to be understood that the present invention may be practiced otherwise than as specifically described herein without departing from the scope and spirit of the invention.

We claim as our invention:

1. An electron beam indicator tube comprising:
fluorescent trios;
a plurality of linear cathodes disposed respectively opposite to the fluorescent layers of the fluorescent trios;
control electrodes; and
a common accelerating electrode disposed between the fluorescent trios and control electrodes;
characterized in that the common accelerating electrode is curved with respect to the direction of extension of the linear cathodes in a convex shape bulging out toward the fluorescent layers, and is formed so that the width of electron beam transmission apertures decreases from the central portion toward the opposite ends of the electron beam transmission apertures.

2. An electron beam indicator tube comprising at least one fluorescent trio formed with red, green and blue fluorescent layers, a plurality of extending linear cathodes, respectively mounted opposite to said red, green and blue fluorescent layers, control electrodes, a common accelerating electrode mounted between said red, green and blue fluorescent layers and said control electrodes, and said common accelerating electrode curved so as to extend outwardly in the center from said linear cathodes toward said red, green and blue fluorescent layers and formed such that the width of apertures in said common accelerating electrode become narrower at the ends than at the middle of said apertures.

3. An electron beam indicator tube according to claim 2 wherein said apertures are barrel-shaped.

4. An electron beam indicator tube according to claim 2 wherein the ratio of the areas of the red fluorescent layer to the green fluorescent layer is in the range of 0.4 to 0.6 of red to 1 to 2 of green.

5. An electron beam indicator tube according to claim 2 wherein the ratio of areas of the green fluorescent layer to the blue fluorescent layer is in the range of 1 to 2 of green to 1 of blue.

6. An electron beam indicator tube according to claim 2 wherein the ratio of the areas of the red fluorescent layer to the blue fluorescent layer is in the range of 0.4 to 0.6 of red to 1 of blue.

* * * * *